US006230935B1

(12) United States Patent
Mack et al.

(10) Patent No.: US 6,230,935 B1
(45) Date of Patent: May 15, 2001

(54) DUAL CHAMBER PUMP DISPENSER

(75) Inventors: Robert Mack, Flemington; James C. McKinney, Cranbury; Kenneth R. Berger, Flemington, all of NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 08/681,022

(22) Filed: Jul. 22, 1996

Related U.S. Application Data

(60) Provisional application No. 60/001,612, filed on Jul. 28, 1995.

(51) Int. Cl.[7] ..... B67D 5/52

(52) U.S. Cl. ..... 222/137; 222/260; 222/321.8; 222/327

(58) Field of Search ..... 222/137, 256, 222/257, 260, 145.1, 321.2, 321.8, 383, 327

(56) References Cited

U.S. PATENT DOCUMENTS

| | | | |
|---|---|---|---|
| D. 277,073 | 1/1985 | Czech . | |
| D. 306,554 | 3/1990 | Lawson . | |
| D. 307,113 | 4/1990 | Thompson . | |
| D. 311,861 | 11/1990 | Vanhoutte . | |
| D. 315,496 | 3/1991 | Pettengill . | |
| D. 356,026 | 3/1995 | Iaia et al. . | |
| 1,363,064 | 12/1920 | Stegath . | |
| 1,676,734 | 7/1928 | Hopkins . | |
| 1,828,865 | 10/1931 | Hopkins . | |
| 1,894,115 | 1/1933 | Murphy . | |
| 2,103,817 | 12/1937 | Johnson . | |
| 2,107,987 | 2/1938 | Johnson . | |
| 2,517,027 | 8/1950 | Rado . | |
| 2,661,871 | 12/1953 | Huenergardt . | |
| 2,939,610 | 6/1960 | Castelli . | |
| 2,944,705 | 7/1960 | Strumor . | |
| 2,959,327 | 11/1960 | Bloom . | |
| 3,105,615 | 10/1963 | Koga . | |
| 3,166,221 | 1/1965 | Neilsen . | |
| 3,182,728 | 5/1965 | Zabriskie . | |
| 3,197,071 | 7/1965 | Kuster . | |
| 3,227,319 | 1/1966 | Rosier . | |
| 3,380,632 | 4/1968 | Wilson . | |
| 3,506,157 | 4/1970 | Dukess . | |
| 3,760,986 * | 9/1973 | Castner et al. | 222/137 |
| 3,788,520 | 1/1974 | Dukess . | |
| 3,881,529 | 5/1975 | Mannara . | |

(List continued on next page.)

FOREIGN PATENT DOCUMENTS

| | | |
|---|---|---|
| 3420324 | 1/1988 | (DE) . |
| 43 35 970 | 4/1995 | (DE) . |
| 29515380 | 1/1996 | (DE) . |
| 0 503 824 | 9/1992 | (EP) . |
| 0576222 | 6/1993 | (EP) . |
| 0 693 437 | 1/1996 | (EP) . |
| 2142611 | 1/1985 | (GB) . |
| 2-205501 | 8/1990 | (JP) . |
| 112375 | 12/1962 | (PK) . |
| WO 94/14680 | 7/1994 | (WO) . |

*Primary Examiner*—Philippe Derakshani
(74) *Attorney, Agent, or Firm*—Michael J. McGreal

(57) ABSTRACT

The dual chamber dispenser consists of two tubular chambers each of which is connected to a pump. The pumps are self-priming and are of a type that draw the substances from the tubular chambers. There is an activator which also serves as the top of the dispenser, side view apertures, a foot for better stability and a spout that is angled for enhanced dispensing. The side view apertures allow for viewing the fill level of the tubular chambers. The pumps are of a type having an upper valve and a lower valve, with the upper valves a part of the piston's that move in and out of the pumping chambers. The valves in said pumps are positive closing by means of a biasing spring. The substances to be dispensed are maintained separate, one from the other, until the substances are dispensed.

16 Claims, 9 Drawing Sheets

U.S. PATENT DOCUMENTS

| | | | | |
|---|---|---|---|---|
| 3,948,704 | | 4/1976 | Evans . | |
| 3,980,222 | | 9/1976 | Hood . | |
| 4,014,463 | | 3/1977 | Hermann . | |
| 4,040,420 | | 8/1977 | Speer . | |
| 4,046,288 | | 9/1977 | Bergman . | |
| 4,089,437 | | 5/1978 | Chutter . | |
| 4,099,651 | | 7/1978 | Von Winckelmann . | |
| 4,148,417 | | 4/1979 | Simmons . | |
| 4,211,341 | | 7/1980 | Weyn . | |
| 4,260,077 | | 4/1981 | Schroeder . | |
| 4,487,757 | | 12/1984 | Kiozpeoplou . | |
| 4,528,180 | | 7/1985 | Schaeffer . | |
| 4,687,663 | | 8/1987 | Schaeffer . | |
| 4,742,940 | | 5/1988 | Wilkinson . | |
| 4,747,517 | | 5/1988 | Hart . | |
| 4,773,562 | | 9/1988 | Gueret . | |
| 4,819,789 | | 4/1989 | Linner . | |
| 4,826,048 | * | 5/1989 | Skora et al. | 222/137 |
| 4,838,460 | * | 6/1989 | Moore et al. | 222/260 |
| 4,949,874 | * | 8/1990 | Fielder et al. | 222/256 |
| 4,964,539 | | 10/1990 | Mueller . | |
| 4,974,756 | | 12/1990 | Pearson . | |
| 4,981,241 | | 1/1991 | Keller . | |
| 5,020,694 | | 6/1991 | Pettengill . | |
| 5,038,963 | | 8/1991 | Pettengill . | |
| 5,045,305 | | 9/1991 | Clarkson . | |
| 5,076,464 | | 12/1991 | Simon . | |
| 5,078,963 | | 1/1992 | Mallen . | |
| 5,137,178 | | 8/1992 | Stokes . | |
| 5,145,668 | | 9/1992 | Chow . | |
| 5,209,376 | | 5/1993 | Dirksing . | |
| 5,224,627 | | 7/1993 | Weag . | |
| 5,244,120 | | 9/1993 | O'Meara . | |
| 5,269,441 | | 12/1993 | O'Meara . | |
| 5,289,949 | | 3/1994 | Gentile . | |
| 5,318,203 | | 6/1994 | Iaia et al. . | |
| 5,332,124 | | 7/1994 | Cancro . | |
| 5,335,827 | | 8/1994 | Gentile . | |
| 5,476,647 | | 12/1995 | Chow . | |
| 5,611,463 | * | 3/1997 | Favre | 222/137 |

* cited by examiner

DUAL CHAMBER PUMP DISPENSER

This application claims the benefit of U.S. Provisional Application No. 60/001,612 filed Jul. 28, 1995.

FIELD OF THE INVENTION

This invention relates to multi-chamber pump dispensers for various products. More particularly, this invention relates to multi-chamber pump dispensers which can dispense the same quantities of viscous materials having differing rheologies. Further this invention relates to a multi-chamber dispenser which utilizes membrane closures for the segregated dispensing of substances.

BACKGROUND OF THE INVENTION

There are various substances which are not compatible. When they are to be used together they must be packaged separately. This can be in two or more fully separate containers, two or more separate containers that are held together by interfitting sections or by means of a tie band, or two or more compartments of a single container. The most cost effective packages are single unitary packages which have a plurality of chambers. These are the most stable in handling and use. Also, they usually will be more compact and will require less material of manufacture. However, a problem with these various packages is the uniform dispensing of the substances from each of the compartments.

One area where multiple chamber containers are useful is in packaging and dispensing pastes such as dentifrices. In dentifrice formulations there can be components that are not highly compatible. These can be basic components and acidic components that are used to produce effervescence in a dentifrice. Likewise, these can be components such as baking soda and a peroxide such as hydrogen peroxide, or an organic peroxide such as urea peroxide These components cannot be packaged in a common container. They must be kept separate until ready for use. The use of dual chamber dispensers solves the problem of keeping such components separate and in addition provides a method for dosing the approximate amount of each component. Another area of use is in dispensing adhesives such as epoxy adhesives. The two reactive components can be kept separate until the time of use. They are then dispensed and promptly used prior to reactively hardening.

The state-of-the-art of dual chamber dispensers for dentifrices is disclosed in several United States Patents. In U.S. Pat. No. 4,773,562 there is disclosed the separate storage of two components in pressurized containers. There is a common activator for these containers and a mixing chamber prior to the paste being dispensed. U.S. Pat. Nos. 5,020,694; 5,078,963; 5,332,124 and 5,335,827 are a series of patents directed to embodiments of the same dual chamber dispenser. In this dual chamber dispenser the dispensing is activated by a manual force of pushing pistons mounted on piston rods upward into dual chambers that contain the substances to be dispensed. These patents also are directed to the structure necessary to maintain the substances separate until dispensed, having the two substances converge when dispensed, the containment structure, and the refill structure. However, the dispenser in each of these patents is conceptually the same dispenser and is activated by a manual force on piston rods that is transferred to a piston in each chamber.

Dual chamber dispensers also are exemplified by the pump dispenser disclosed in U.S. Pat. No. 5,224,627. This patent discloses a dual chamber dispenser which utilizes dual bellows pumps that are activated by means of a common lever actuator. In this dispenser the components of each of the chambers is delivered in a different ratio. The pistons in this dispenser are drawn upwardly by means of a suction force in distinction to the use of piston rods that push a piston and exert a positive pressure on the paste to be dispensed.

In the present dispenser various problems with regard to the prior art dispensers are overcome. The pumping mechanism is of the suction type and can dispense essentially equal amounts of substances having different rheologies. The dispenser is more compact and easier to handle and use. In addition, less plastic is needed for each dispenser resulting in an environmental saving. Further, since compact refill cartridges are used, the plastic usage is further decreased. The base and the pumping head are reused with only the cartridges disposed of after the contents have been depleted.

The present pump dispenser also has a unique technique for maintaining the two streams of substances being dispensed separate until use. The closure is a slit membrane closure which keeps each stream that is being dispensed separate. There is no cross-contamination of one substance with another. In a preferred embodiment each stream exists through a separate slit opening in the membrane. After dispensing the exterior surface of the membrane, closure can be cleaned if necessary. This can be done by cleaning the exterior surface.

This present multi-chamber dispenser solves these many problems. It is an advance in the art of multi-chamber dispensers, and particularly multi-chamber dispensers that pump substances by suction rather than by a direct force on a piston, such as through the use of an arrangement of a piston rod directly acting on a piston.

BRIEF SUMMARY OF THE INVENTION

The present pump dispenser is comprised of an upper section and a lower section. The upper section and the lower section preferably releasably fit together. The lower section is comprised of at least two tubular chambers which contain the substance to be dispensed. There also is a shroud which encircles the tubular containers and which connects to the upper section. This shroud preferable has apertures along each side wall which function as windows permitting an observation of the fill level of substance in each tubular container. The tubular containers preferably are removable from the shroud and the shroud separable from the upper section, and, as an option, the tubular containers are joined together at the top, bottom, or otherwise along a portion of their longitudinal surface. Additionally, in a preferred mode, the joined tubular containers are keyed to fit into the lower section in a single orientation. Replacement tubular chambers have a piston closing the bottom and a foil or other seal on the upper end. Further, at the lower end of the shroud of the lower section, as a part of the front surface, there is an extended foot portion to provide stability to the lower portion when supported on a surface during dispensing.

The upper section contains the pump means, pump actuator means and spout to deliver the substance contained in each of the tubular chambers. The pump means are adjacent to the lower part of the upper section and fit onto the top of each of the tubular containers of the lower section. The pump means preferably are a double valve, self-priming pump means, with a separate pump means fitted onto the top of each tubular chamber. Extending from each pump means is a channel that terminates in a spout, with each channel extending to the spout exit. At the spout exit there is a hinged closure which can be rotatable through a 180 degree arc or a slit membrane closure.

A slit membrane closure is a self-closing and self-sealing closure. It maintains the substance in the spout moist since there is minimal air contact. There can be one or more slits extending across both channel openings or separate slits for each channel. There will be a positive cut-off of the product being dispensed. Also, the membrane closure can be designed so that there is no mixing of the substances being dispensed through each channel, The slit can be a single slit traversing each channel or in the alternative there can be a pattern of slits across each channel. Optionally, the same slit can traverse both channels. The slit arrangement and design will be dependent on the substance being dispensed.

The pump consists of a two valve suction pump mechanism for each container. The pump mechanism can deliver essentially equal volumes of products from each chamber even if the rheologies of the products differ. It is a characteristic of the suction pump to be affected by the rheology of the substances being pumped. The delivery of equal volumes of such substances is accomplished by using rigid valves and a mechanism to assure the positive closing of each valve. Rigid valves are used in contrast to elastomeric or flexible valves. With elastomeric valves the closing of the valves is not assured and elastomeric materials absorb organics, such as flavor oils, and other components from a substance. This causes the elastomeric to change as to its characteristics with yet additional valve operating problems. In addition, there is needed a mechanism to bias the valve in a closed position. Preferably this is a spring mechanism. This bias mechanism is a part of each of the valves in the pump. The rigid valves have a positive closing with a movement of the full valve to and from a valve seat.

The pumping mechanism is comprised of two or more pumping chambers. There is a pumping chamber associated with each tubular container. A lower valve in each pumping chamber is in contact with the substance in a tubular container. The upper valve is located at the top of a pumping chamber and forms the upper surface of the pumping chamber. In a preferred embodiment this valve is a part of the pump piston. Between the lower valve and upper valve is the pumping chamber which is of a volume essentially equivalent to a full dose from a dispensing cycle. In a dispensing cycle the piston, which contains the upper valve, is pushed downwardly with the substance in the pumping chamber dispensed from the pumping chamber to the pump spout. When the activating force is released and the piston moves upwardly, the upper valve closes and the lower valve opens to draw the substances in the tubular containers up into the pumping chamber. As an added feature, the pump is self-priming due to each pump chamber having two valves.

The exit of each tubular chamber can be off-set from the longitudinal axis of the tubular chamber in order to minimize the path of the substances from the pumping chambers to the spout. This results in a decreased pumping force to dispense the substances. Further, the lower end of each pump chamber can have an associated knife arrangement to pierce any foil or other covering over the upper ends of the tubular chambers.

This multi-chamber dispensing pump solves many problems of past multi-chamber pump dispensers. It is compact, light weight, has a low actuation force has replaceable cartridges, can be used with substances with different rheologies and maintains the substances separate throughout actuation.

BRIEF SUMMARY OF THE DRAWINGS

FIG. 3 is a vertical sectional view of the pump dispenser along line 3—3 of FIG. 2.

DETAILED DESCRIPTION OF THE INVENTION

The present pump dispenser will be discussed in more detail with reference to the drawings.

Figure 1:
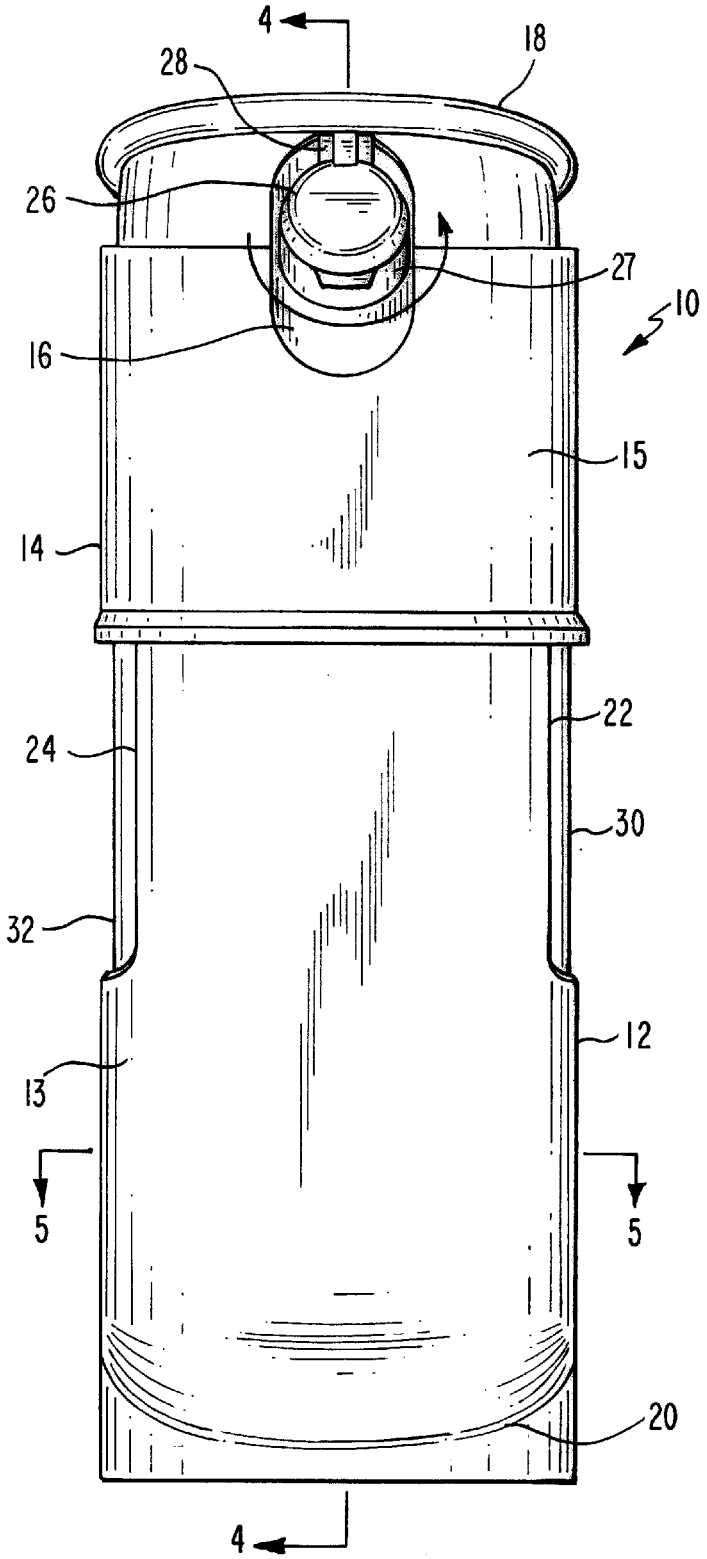
FIG. 1 is a front elevational view of the pump dispenser.

FIG. 1 shows dispenser 10 which consists of lower section 12 and upper section 14. The lower section is comprised of shroud 13 and at the bottom of the lower section a foot support 20 which aids in supporting the dispenser during use. The lower section 12 has elongated apertures 22 and 24 on each side. This lower section holds tubular containers 30 and 32 and is removably interconnected with the upper section 14. The tubular containers hold the substances that are to be dispensed.

The upper section 14 is comprised of a shroud 15, spout 16 and a pump actuator 18. The pump actuator 18 is connected to each of the pumps and serves to activate each of the pumps simultaneously upon being depressed. The spout 16 extends at an angle from the shroud 15 and on its end is cap 26 which is attached to cap base 27 by hinge 28. Cap base 27 attaches to spout 16 and rotates the closure through a 180 degree arc. In this way the cap portion 26 of the closure can be rotated so as not to interfere with dispensing the paste. An alternate slit membrane closure is shown in FIGS. 9 to 13 and will be discussed with reference to these figures.

Figure 2:
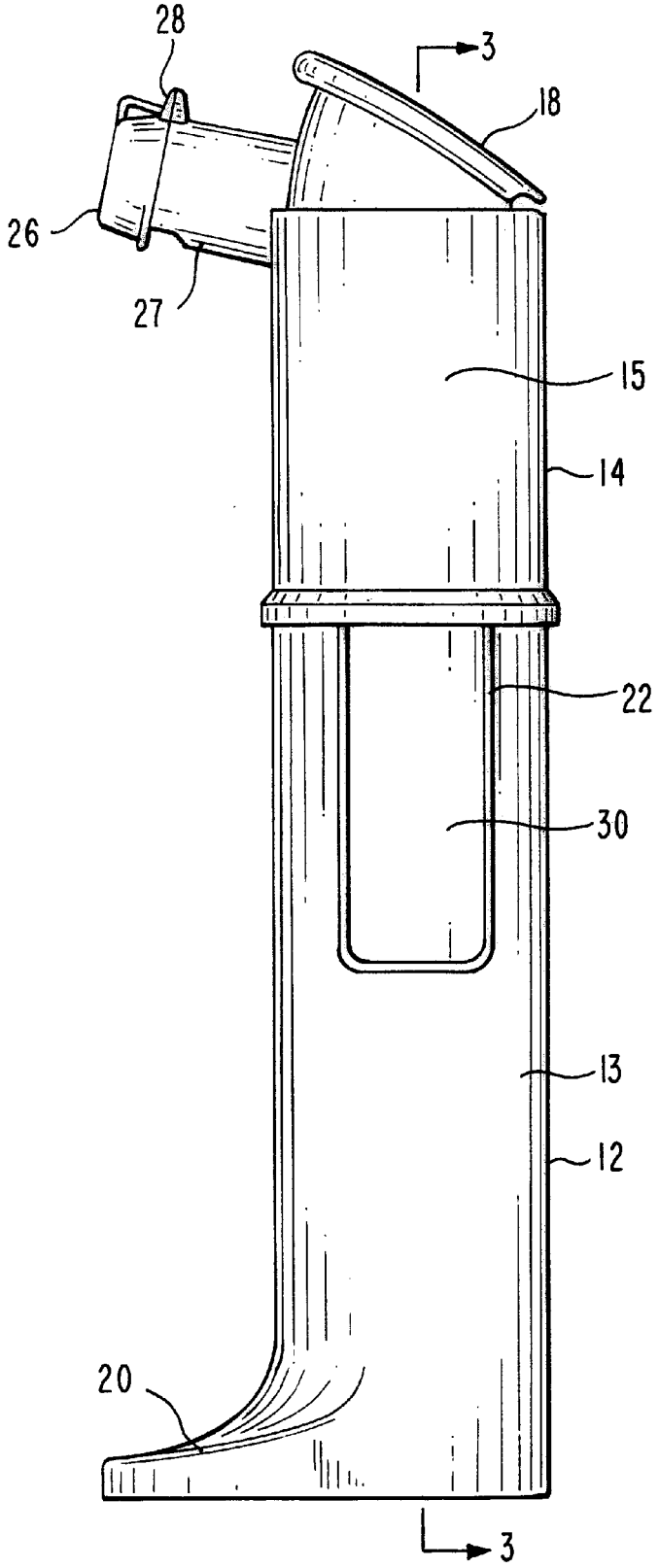
FIG. 2 is a side elevational view of the pump dispenser.

FIG. 2 is a side elevational view of the dispenser. This view shows the elongated aperture 22 and tubular chamber 30. The apertures act as a view windows providing information of the fill status of the tubular containers of the dispenser. The foot support 20 is better shown in this view. The foot support provides stability when the dispenser is activated while on a surface rather than being held while being activated.

FIG. 3 shows the internal construction of the dispenser. The upper section 14 holds the pumping mechanism while the lower section 12 holds the substances to be dispensed in tubular chambers 30 and 32. These tubular chambers slideably interfit into shroud 13. At the lower end of tubular container 30 is piston 40 and at the lower end of tubular chamber 32 is piston 50. The tubular chambers are maintained within shroud 13 by bottom wall 21 of the lower section. The tubular containers are connected at the top by bridge piece 31 and at the bottom by bridge piece 33.

The upper section contains the pumping mechanism. This pumping mechanism is a suction type which draws the substances upward from each of the tubular chambers. Each pumping chamber has two valves and it is self-priming. The drawing of the substances from each tubular chamber creates a reduced pressure in each tubular chamber which draws the substances upward into the pumps. This also draws the pistons upwardly. The substances are then discharged in a subsequent operation of the pumps.

The upper section contains pumps 42 and 52. Pump 42 is comprised of pump wall 43 and pump 52 is comprised of pump wall 53. At the lower end of pump 42 are support spokes 34 and rigid valve 49. Rigid valve 49 is biased closed by spring 35. The support spokes support the rigid valve member and in turn are attached to pump wall 43. Spokes 34 terminate in inlet port 38 of pump 42. Inlet port 38 will be in contact with the substance in container 30. Upper rigid valve 45 is supported by support spokes 47. Spring 23 biases valve 45 in a dosed position. Piston 41 holds the support spokes 47 and moves slideably with regard to pump wall 43. The upper valve 45 is a part of piston 41 and moves upwardly and downwardly with piston 41. Pump 42 is connected by intermediate channels 44 and 46 to exit channel 48. Exit channels 48 and 58 of the dispenser are separated by wall 60. Wall 60 extends to the exit of the spout to keep the channels separate until the substances are dispensed.

Pump 52 has the same structure as pump 42. Pump 52 has a lower rigid valve 69 which is supported by spokes 36. Spring 37 biases valve 69 in a closed position. Spokes 36 terminate in inlet port 39. Inlet port 39 is in contact with the substance in container 32. Pump wall 53 defines the pump chamber. The upper rigid valve is comprised of valve 55 supported by support spokes 57. Spring 25 biases valve 55 closed. Piston 51 slideably contacts the pump wall 53. Upper rigid valve 55 is a part of piston 51 and moves upwardly and downwardly with piston 51. The pump 52 opens into intermediate channel 54. Intermediate channel 54 is interconnected to channel 56 which in turn is interconnected to exit channel 58 of the spout.

Figure 3A:
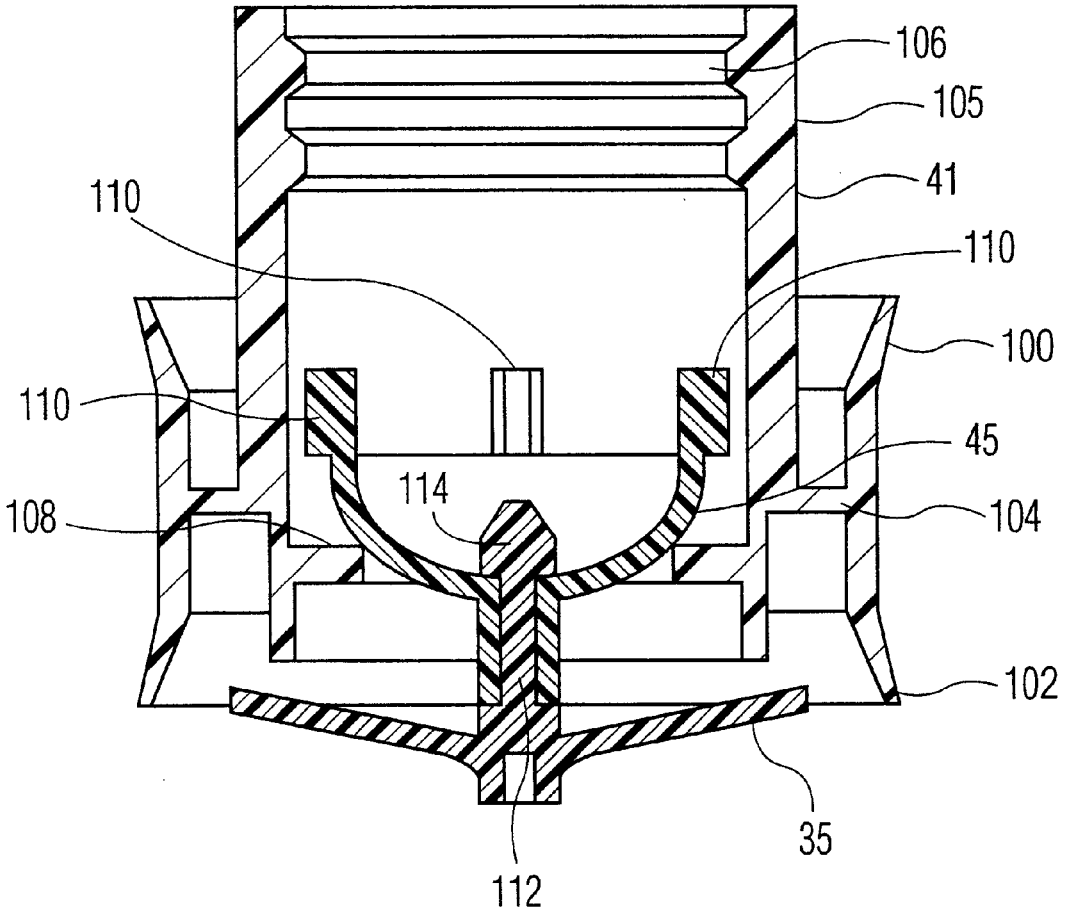
FIG. 3A is an exploded view in section of the upper valve of the pumping chamber.
Figure 3B:
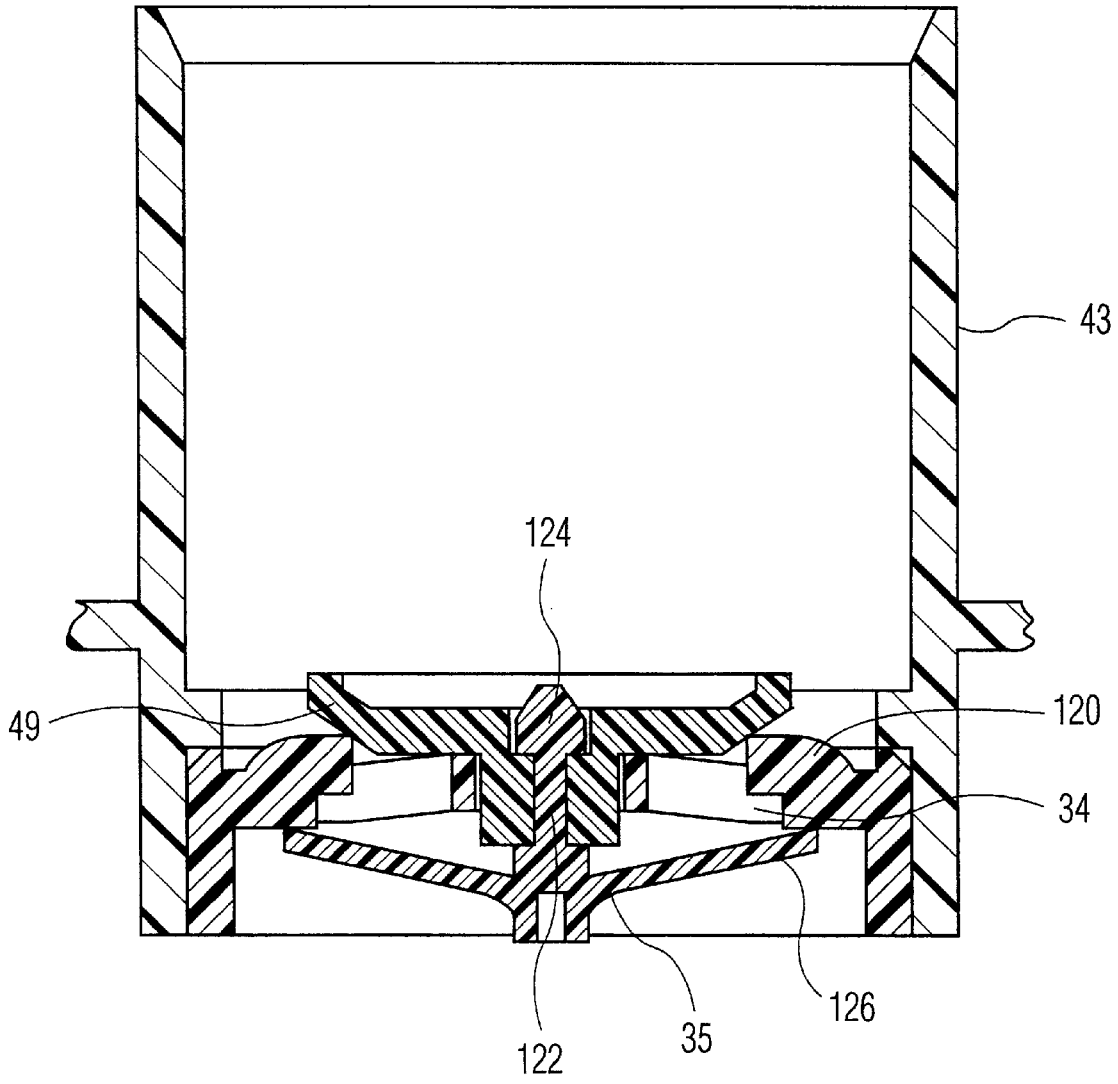
FIG. 3B is an exploded view of the lower valve of the pumping chamber.

FIG. 3A is an exploded view of the upper valve of each pump chamber and FIG. 3B is an exploded view of the lower valve of each pump chamber. These valves will be described with regard to pump chamber 42 with the understanding that the values of pump chamber 52 have the same structures. The upper valve as shown in FIG. 3A is a part of piston 41. Piston wall 105 has a series of ridges 106 on an internal surface for attachment onto piston support 74. Prefereably piston support 74 has mating ridges. On a lower portion of piston wall 105 is the piston seal support 104 which carries cylinder wall seals 100 and 102. These seals contact cylinder wall 43 and ride along the cylinder wall. Valve 45 contacts valve seat 108 and seals against this valve seat. Valve 45 has upwardly extending guide arms 110. Spring 35 is attached to valve 45 by stem 112 and enlarged projection 114. As can be seen, the arms of spring 35 will bias the valve in the closed position.

The lower valve is shown in FIG. 3B. Cylinder wall 43 carries the valve 49 at its lower end. The valve consists of valve seat 120, rigid valve 49 and spring 35 to bias the valve in the closed position. Spokes 34 support the valve. Spring 35 has arms 126 attached to valve 49 by stem 122 and enlarged projection 124. Spring arms 126 flex and provide the spring action. The valve seat is mechanically or adhesively attached to pump wall 43.

With further reference to FIG. 3, the pump actuator 18 is connected to piston 41 and piston 51 by means of upper frame support 70. The upper frame support has guide sections 72 and piston supports 74 and 76. Piston support 74 has piston 41 mounted thereon and piston support 76 has piston 51 mounted thereon. Each of these pistons except for the valve contained in the piston are of a flexible elastomeric material. The upper frame support 70 in addition has tubular extension 62 which slideably fits over guide pin 64. Spring 63 biases upper support frame 70 upwardly and actuator 18 in the unactivated rest position. Guide pin 64 is mounted on lower frame support 66. This lower frame support is attached to the inner surface of shroud 15. This anchors the lower frame support. Pump walls 43 and 53 project upwardly from the lower frame support and are a part of the lower frame support. Circumferential section 73 of the lower frame support provides for the attachment to the inner wall of shroud 15.

Upon the activation of pump actuator 18 upper frame support 70 moves downward and forces pistons 41 and 51 downward into pump chambers 42 and 52 respectively. Upper valves 45 and 55 open. Lower valves 59 and 69 remain closed. This decreases the volume in each of these pump chambers and forces the substance in pump 42 into channel 44 and then into channel 46 and exit channel 48. At the same time the substance in pump chamber 52 is forced into channel 54 and then into channel 56 and exit channel 58. As upper frame support 70 is pushed downwardly by depressing actuator 18, tubular extension shaft 62 slideably moves over guide pin 64. Spring 63 is tensioned, biases the upper frame support 70 upwardly and thus actuator 18 upwardly. This also maintains the pumps 42 and 52 in the non-depressed condition as shown in FIG. 3 when the actuation pressure is released.

As the upper frame support 70 moves upwardly, piston 41 and piston 51 move upwardly. Upper valves 45 and 55 are closed creating a reduced pressure in pump chambers 52 and 42 respectively. As a result, valve 49 of pump 42 and valve 69 of pump 52 are opened with the substances in tubular chambers 30 and 32 respectively being drawn by suction upward into pump chambers 42 and 52. The dispenser is then ready for another dispensing cycle.

These pumps are self priming pumps. By depressing the actuator several times, the pump chambers when empty are filled with the substances from the tubular chambers. Further depressing of the activator causes the substances to be dispensed with each downward stroke of the activator. As the substances are being dispensed, pistons 40 and 50 are drawn upwardly in each tubular chamber.

Figure 4:
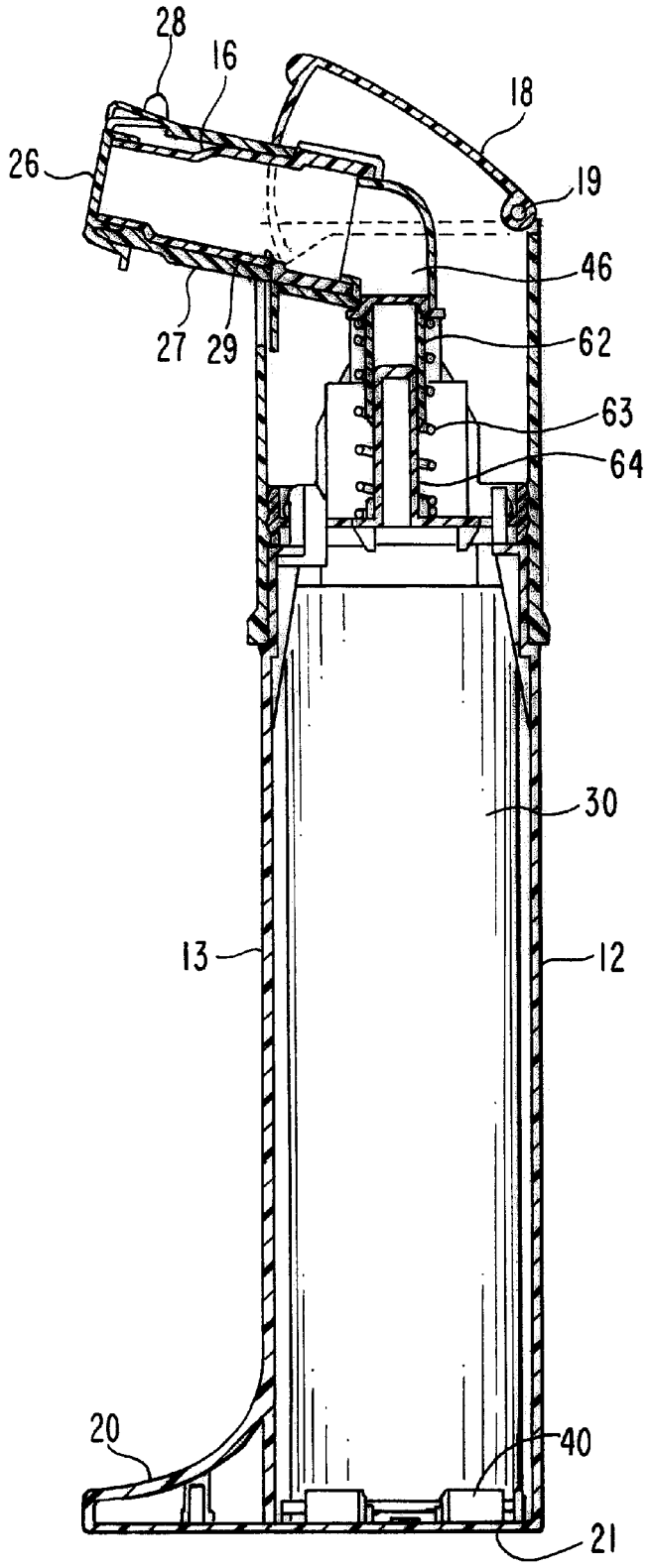
FIG. 4 is a vertical sectional view of the pump dispenser along line 4—4 of FIG. 1.

FIG. 4 is a side elevational view of the dispenser. The closure extension 29 is fully rotatable on spout 26 through 180 degrees. Pump actuator 18 is shown pivoted at axis 19. This axis 19 is located at the rear of the dispenser. As actuator 18 is depressed, the spout 16 (along with cap 26) and the remainder of the upper part of the pump assembly that is a part of upper frame 70 moves downwardly. As has been described, this changes the volume in pump chambers 42 and 52 and provides the force to pump the substances from the tubular chambers to the dispenser exit.

Figure 5:
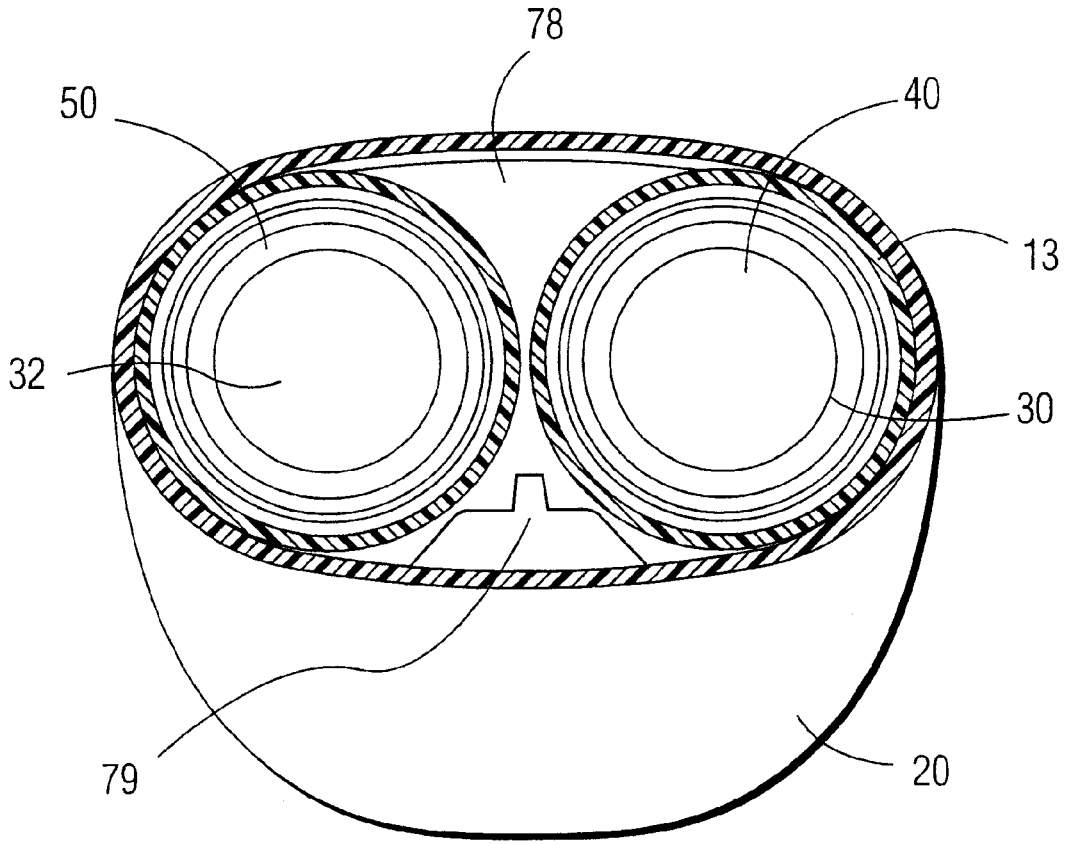
FIG. 5 is a horizontal sectional view of the pump dispenser along line 5—5 of FIG. 1.

FIG. 5 is a cross-sectional view of the dispenser along line 5—5 of FIG. 1. This shows the foot 20, tubular chambers 30 and 32 and pistons 40 and 50. Also shown are keys 78 and 79 which permit the cartridge assembly to be inserted in only one orientation. Key 79 cooperates with key slot 82 of projection 80 (see FIG. 6). In this way the tubular chambers which are connected longitudinally at common points can only be fitted into shroud 13 in a single orientation. If not in the proper orientation, the tubular chambers will not seat in shroud 13 so that upper portion 12 can be fitted into the shroud 13.

Figure 6:
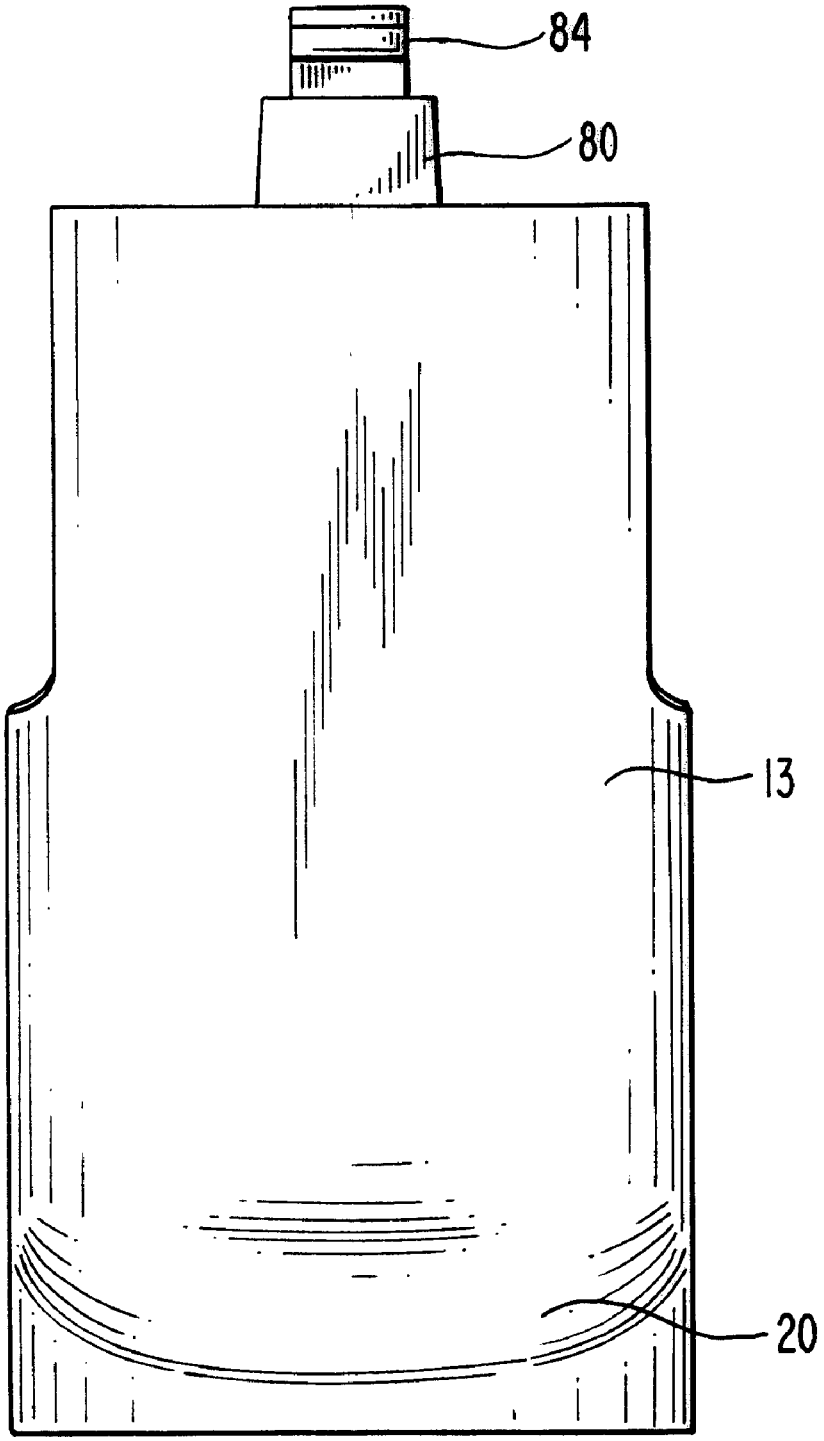
FIG. 6 is a front elevational view of the lower section separated from the upper section.

FIG. 6 shows the lower section 12 with shroud 13. Lower section 12 and upper section 14 are detachable. Projection 80 extends upwardly from the front surface and projection 84 extends upwardly from the rear surface. Projection 80 on the inner surface has a keyway which interfits into key slot 79 of the cartridge. As a result the cartridge only can be inserted in one orientation. In this way there will not be any cross-contamination of the substances in the pump chambers when a new refill cartridge is used.

Figure 7:
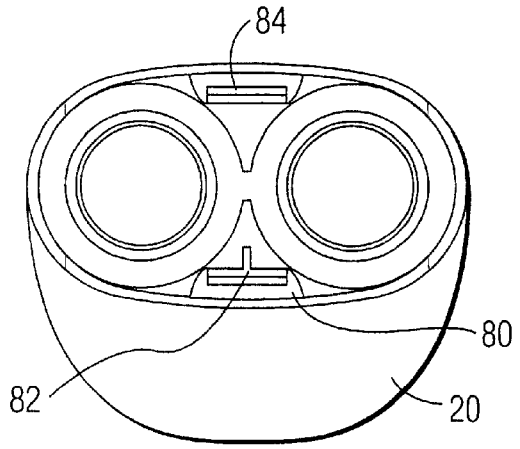
FIG. 7 is a top plan view of the lower section of FIG. 6.
Figure 8:
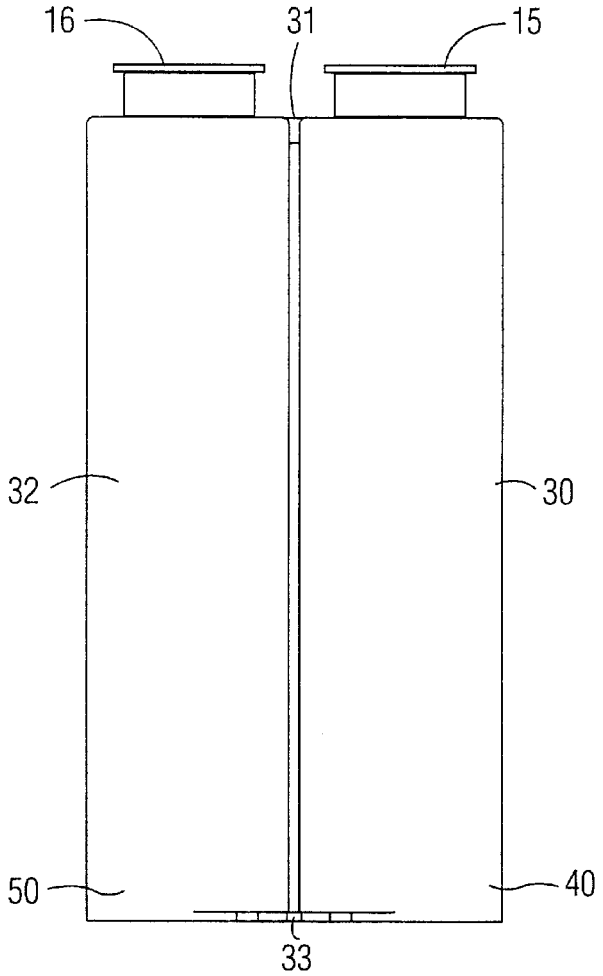
FIG. 8 is a front elevational view of a refill cartridge for the dispenser.

The cartridge refill in the shroud is are shown in FIG. 7. It is seen that projection 80 carries a keyway 82 which interfits with a key slot 79 on the cartridge. In FIG. 8 there is shown a refill cartridge. This refill cartridge is sealed on the upper end by seals 15 and 16. Pistons 40 and 50 seal the bottoms of the tubular chambers.

Figure 9:
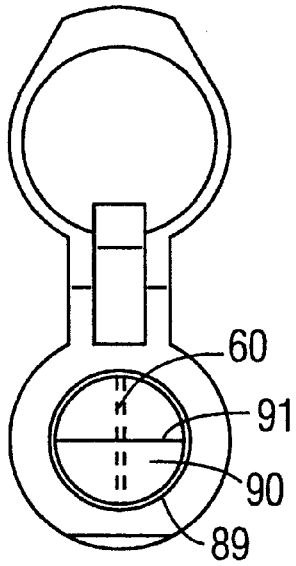
FIG. 9 is a view of the spout of the pump dispenser with an overcap having a membrane closure with the dispensing slit extending across each channel.
Figure 10:
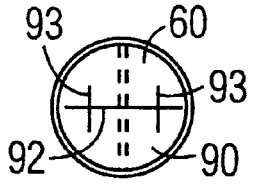
FIG. 10 is a view of the spout of the pump dispenser having a membrane closure with the dispensing slit having dispensing slits depending therefrom.
Figure 11:
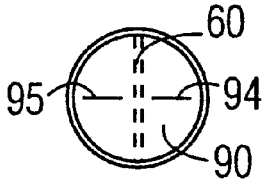
FIG. 11 is a view of the spout of the pump dispenser having a membrane closure with a separate slit for each channel.
Figure 12:
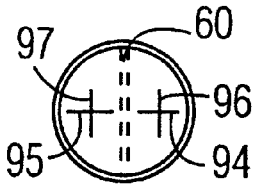
FIG. 12 is a view of the spout of the pump dispenser having a dispensing membrane closure with more than one separate slit for each channel.
Figure 13:
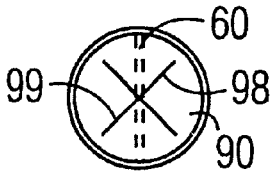
FIG. 13 is a view of the spout of the pump dispenser having a dispensing membrane closure with two slits which extend across each channel.

FIGS. 9 through 13 describe an alternate embodiment to the closure shown in FIGS. 1 through 4. In FIGS. 9 through 13 there is used a membrane valve at the exit to the spout 16. This consists of a piece of flexible elastomeric material containing one or more slits which close off the spout. As shown in FIG. 9, this membrane 90 has a slit 91. In this embodiment, the slit 91 is shown as extending across both channels 48 and 58 of spout 16. Other designs for the slit are shown in FIGS. 10 through 13. In FIG. 10 there is shown cross slits 92 and 93. This is a version of the slit opening of FIG. 9 with perpendicularly intersecting slits across each spout channel. In FIG. 11 there are shown separate slits 94 and 95 across each spout channel. FIG. 12 is an embodiment of the slit design of FIG. 10 but with there being a separate slit 96 and 97 for each spout chamber. In FIG. 13 there is shown a slit consisting of two slits 98 and 99 each of which extends across each spout channel and which intersect at the wall 60 dividing the spout channels.

The membrane closure can be constructed of essentially any elastomeric material. This includes the different homopolymers and copolymers of butadiene. However, the preferred membrane closures are silicones since they exhibit a rapid return to their initial closed position after a dispensing and further provide for a sharp cut-off of the substances being dispensed.

The dispenser shrouds including the foot of shroud 13 are made out of a rigid thermoplastic as are the spout, actuator, upper frame support and lower frame support and activator. Suitable thermoplastics are polyethylene, polypropylene, acrylonitrile-butadiene-styrene or any other easily injection moldable rigid thermoplastic material.

The tubular containers can be of any rigid plastic with polyethylene terephthlate, polybretylene terephthalate, polyethylene and polypropylene resins being very useful. The pistons and valves are usually a thermoplastic such as polypropylene of low to high density. The valves also may be fashioned on any of the injection moldable plastic resins such as ethylene vinyl acetate and styrene-butadiene-styrene block copolymers. It is preferable to select valve materials which are resistant to absorbing organic such as flavor oils or other components of the materials to be dispensed in the pumps. Most of the parts are readily made by injection molding The pistons in the refill cartridge can be a rigid type, deformable type or have a reshapeable polymeric foam top surface. The rigid type is usually of a plastic such as polyethylene or polypropylene where the top of the piston does not deform when it contacts another surface. A deformable piston is one that has a shape that conforms with that of a surface which it will contact and due to the surface being deformable will fully fit into that surface. A polymeric foam piston is one which has an upper part that is a polymeric foam such as a polyurethane foam and which changes in shape to conform to the shape of a surface which it contacts. This can be soft to a more rigid foam. The advantage of a foam piston is that when a cartridge is removed there is no substance residue on the mating surface. The lack of a residue results in a clean separation of the cartridge from the pump with no smearing of the substances onto the inner parts of the upper section of the pump.

The description of the dispenser discloses the preferred embodiments of the dispenser with various modifications possible and yet be within the concepts of this dispenser. All such modifications are considered to be a part of the present development.

We claim:

1. A pump dispenser comprising an upper section and a lower section, said upper section and said lower section being separable, said lower section containing at least two tubular containers which extend from adjacent a bottom end of said lower section to adjacent a top of said lower section, each of said tubular containers closed at a lower part thereof by a piston; said upper section containing at least two pump means, the input of each pump means aligned with a top of a tubular container of said lower section to draw a substance in each tubular chamber into each of said pump means, conduit means aligned with the exit of each pump means and providing a separate channel to an exit of a spout, and a pump actuator means pivoted at an upper part of said upper section opposite said spout and contacting each of said pump means whereby upon depressing said pump actuator means a portion of the substance in each tubular chamber is dispensed from said spout.

2. A pump dispenser as in claim 1 wherein the lower section has a front surface, a rear surface and side surfaces, the bottom end of the front surface of said lower section extends outwardly to support said pump dispenser upon operation of the pump actuator means.

3. A pump dispenser as in claim 1 wherein the lower section has a front surface, a rear surface, and two side surfaces, at least one of said side surfaces has an aperture therein.

4. A pump dispenser as in claim 3 wherein each side surface has an aperture therein. /

5. A pump dispenser as in claim 6 wherein said upper section has a front surface, or rear surface and two side surfaces, said pump actuator means substantially encompassing said top surface and having pivot means adjacent said rear surface.

6. A pump dispenser as in claim 1 wherein said spout has a closure mounted thereon, said closure rotatable on said spout.

7. A pump dispenser as in claim 1 wherein said spout has a membrane closure mounted thereon, said membrane closure having at least one elongated slit thereon, said at least one elongated slit traversing at least a portion of each channel of said spout.

8. A pump dispenser as in claim 7 wherein said one elongated slit has at least one additional slit extending at an angle therefrom.

9. A pump dispenser as in claim 8 wherein said additional slit extends at about an angle of about 90 degrees.

10. A pump dispenser as in claim 1 wherein said spout has a membrane closure mounted thereon, said membrane closure having at least one elongated separate slit traversing each channel of said spout.

11. A pump dispenser as in claim 10 wherein at least one of said slits has an additional slit extending at an angle therefrom.

12. A pump dispenser as in claim 11 wherein said additional slit extends at an angle of about 90 degrees.

13. A pump dispenser as in claim 1 wherein said upper section and lower section are detachable at the junction of said upper section and said lower section.

14. A pump dispenser as in claim 13 wherein said tubular containers are removable from said lower section.

15. A pump dispenser as in claim 1 wherein said tubular containers are connected along a portion of each longitudinal surface thereof.

16. A pump dispenser as in claim 15 wherein said connected tubular containers fit into said lower section in a single orientation so that the same substance can be dispensed by the same pump means in the top portion.

* * * * *